US005271237A

United States Patent [19]

Popelka et al.

[11] Patent Number: 5,271,237

[45] Date of Patent: Dec. 21, 1993

[54] APPARATUS FOR CONDENSATE REMOVAL

[75] Inventors: Andrew Popelka, Acton; Barry M. Cohen, Newton Centre, both of Mass.

[73] Assignee: Electric Power Research Institute, Inc., Palo Alto, Calif.

[21] Appl. No.: 988,571

[22] Filed: Dec. 10, 1992

[51] Int. Cl.[5] ..... F25D 17/02; G05D 11/00

[52] U.S. Cl. ..... 62/179; 62/188; 137/112

[58] Field of Search ..... 62/188, 288, 289, 179; 417/40, 36; 137/112

[56] References Cited

U.S. PATENT DOCUMENTS

| | | | |
|---|---|---|---|
| 2,941,712 | 6/1960 | Cook | 417/40 X |
| 3,686,452 | 8/1972 | Opiela | 417/40 X |
| 4,475,569 | 10/1984 | Föller | 137/194 |
| 4,482,299 | 11/1984 | Eulass | 417/40 X |
| 4,748,821 | 6/1988 | Berenter | 62/188 |
| 4,856,672 | 8/1989 | Sullivan | 220/82 |
| 5,071,027 | 12/1991 | Sullivan | 220/571 |
| 5,074,119 | 12/1991 | Anderson | 62/150 |

FOREIGN PATENT DOCUMENTS 0268928 11/1986 Japan ..... 62/188

OTHER PUBLICATIONS

Electric Power Research Institute, "Heat Pump Manual," EM-4110-SR, 1985.

Electric Power Research Institute, "Heat Pump Thermal Distribution Systems," CU-6962, vols. I and II, Aug. 1990.

*Primary Examiner*—William E. Wayner

*Attorney, Agent, or Firm*—James W. Maccoun

[57] ABSTRACT

In a heating, ventilation and air conditioning system such as a heat pump having a multi-zone hydronic thermal distribution system or such as an air conditioner, a novel condensate removal apparatus removes condensate from each zone fan coil. Each fan coil uses a valve to drain condensate from a fan coil drip pan into a drainage conduit. The drainage conduits from each valve carry condensate to a tank. The tank acts as a manifold for fluid collection from the different fan coils. A single pump draws condensate from fan coils through drainage conduits to the tank. This same pump draws a vacuum in the tank and the drainage conduits. The pump uses a single outlet conduit to discharge condensate.

6 Claims, 5 Drawing Sheets

APPARATUS FOR CONDENSATE REMOVAL

BACKGROUND OF THE INVENTION

1. Field of Invention

This invention relates to an apparatus for removing condensate generated by fan coils that are employed in a heating, ventilation and air conditioning system such as a heat pump thermal distribution system or an air conditioner. More specifically, this invention relates to a novel apparatus that uses drain valves and a pump to remove condensate from fan coils. This invention is particularly applicable for condensate removal where gravity, long drain conduit runs, or other conditions impair condensate drainage. This invention permits a single condensate removal pump to service multiple fan coils.

2. Description of the Related Art

Heat pumps are used for air-conditioning in the comfort heating and cooling of space in commercial and residential structures. During the past decade, heat pumps have rapidly increased in popularity. The attractiveness of heat pumps is a result of their power efficiency as well as their increasingly competitive cost of purchase and installation. The present invention is used to remove condensate generated by heat pumps operating in the cooling mode.

Heat pumps are generally described in *Heat Pump Manual*, Electric Power Research Institute, 1985. A heat pump uses the same equipment to cool conditioned space in the summer and to heat it in the winter, maintaining a generally comfortable temperature within a structure at all times. Two heat exchange coils are used in a heat pump. One coil is located within the conditioned space while the other coil is located outside the structure. When heating the conditioned space, the inside coil serves as a condenser and the outside coil serves as an evaporator. When cooling the conditioned space, roles are reversed and the inside coil serves as an evaporator while the outside coil serves as a condenser. The heat exchange coil that is inside the structure and the heat pump equipment that is co-located with that coil are collectively referred to herein as the "inside unit." Their counterparts outside the structure are referred to herein as the "outside unit."

The present invention is used with heat pumps that distribute a cooling liquid to multiple areas. These multiple areas are typically separate rooms within a structure. Such areas are often referred to as "zones" and heat pumps that condition multiple zones are often referred to as having "multi-zone thermal distribution systems."

Multi-zone thermal distribution systems can be classified according to the type of fluid used for thermal distribution. The air-to-air system, the type of system that is presently the most common in use, employs air ducts to deliver cool air from the inside unit to vents located at each zone. The present invention is not used with air-to-air systems since their air vents do not produce condensate.

The air-to-water thermal distribution system, also known as the "hydronic" system, employs water conduits to supply cooling water from the inside unit to fan coils located in the conditioned zones. Such fan coils are referred to herein as "zone fan coils." In this system, the heat exchanger coil of the inside unit, which is refrigerant cooled, is used to cool supply water and is thus a refrigerant-water interface. Cooled supply water is pumped through a water supply conduit to the zone fan coils. Zone fan coils, cooled by the supply water, are a water-air interface. A fan blows air over the water cooled coil surface resulting in cooling of that air. After having cooled the zone fan coil, the water is pumped through a return conduit back to the inside unit for further use thus completing a supply-return water circuit.

Cooling a zone fan coil causes moisture in air to condense to form water condensation on cool coil surfaces. As condensate accumulates, it drips off the coil to collect in a drip pan for the zone fan coil. Removal of this condensate from hydronic zone fan coils is the focus of the present invention.

Another type of thermal distribution system uses zone fan coils but, in contrast to hydronic systems, employs a supply-return conduit to deliver cool refrigerant to zone fan coils. The refrigerant cools coil surfaces in the zone fan coils and the fan coils otherwise operate—and cause water condensation—similar to hydronic systems. Accordingly, the present invention may also be used to remove condensate from refrigerant driven zone fan coils.

Hydronic systems have advantages over both air-to-air systems and refrigerant driven zone fan coils. Cost of installation is usually lower for hydronic systems as compared to both air-to-air systems and refrigerant driven zone fan coils. Hydronic systems use compact water supply-return conduits in contrast to the relatively large, bulky and difficult to configure air ducts employed by air-to-air systems. These compact hydronic conduits are more readily routed through restricted wall cavities than bulky air ducts. Hydronic systems also offer an installation cost savings over refrigerant driven zone fan coils because a plumber can install a hydronic supply-return conduit while a more highly paid refrigeration technician is required to install supply-return conduit for refrigerant driven zone fan coils.

Conventional condensate removal systems provide the drip pan of each zone fan coil with a separate drain conduit that leads directly through a hole in an exterior structure wall or through a window. Condensate then drains directly to discharge points outside the structure at an above-ground level. This system relies upon gravity to produce condensate flow through removal conduits.

the through-the-wall, condensate removal system described in the previous paragraph, while appealing in its directness and simplicity, has limits. Absence of convenient holes through which to route drain conduits are one potential limitation. A fan coil servicing a zone that is not adjacent to an exterior structure wall or window would require a long run of drain conduit resulting in the routing problems and the flow problems of long runs. Drain conduit servicing fan coils located in a basement or in another type of below-ground zone cannot rely upon gravity to drain condensate to an above-ground discharge point. Moreover, even for above ground fan coils, conduit routing constraints may require upward conduit runs which would impair gravity driven condensate flow.

The conventional solution to the drainage problems described in the previous paragraph is to use condensate removal pumps located in each fan coil. Each fan coil with impaired drainage is fitted with a condensate removal pump to draw condensate to respective outside discharge points. This approach requires drainage conduits to the outside for each fan coil and requires separate condensate removal pumps for each fan coil. A requirement for multiple drainage conduit routes increases installation costs and a requirement for multiple condensate removal pumps increases system purchase cost. Each of the multiple pumps requires such related equipment as plumbing, electrical connections, wiring, and circuit breakers. Through-the-wall drainage to outside discharge points may also be undesirable for aesthetic or safety reasons such as exist in locations having pedestrian traffic. Accordingly, a novel condensate removal apparatus is desired which avoids these costs and limitations.

SUMMARY OF THE INVENTION WITH OBJECTS

It is a general object of this invention to provide an improved apparatus for air conditioning in the comfort heating and cooling of space in commercial and residential structures.

It is an object of the invention to provide an improved apparatus for removing condensate from multiple fan coils in a heat pump having a multi-zone thermal distribution system.

It is another object of the invention to provide an improved apparatus which uses a single pump to remove condensate from multiple fan coils in a multi-zone system.

It is another object of the invention to provide an improved apparatus which uses a single condensate discharge point to serve multiple fan coils in a zoned system.

It is another object of the invention to provide an improved apparatus which removes condensate from fan coils that have upward drainage conduit runs and which removes condensate from fan coils which are located below the discharge point for removed condensate.

It is still another object of the invention to provide an improved apparatus which removes condensate from fan coils that are separated from a discharge point by long drainage conduit runs.

These and other objects are accomplished with a novel condensate removal apparatus. The present invention uses a valve to remove condensate from a fan coil drip pan into a drainage conduit. The drainage conduit carries condensate to a tank that is located at the indoor unit. Each fan coil of a multi-zone system is similarly configured with a condensate valve and a drainage conduit. The tank acts as a manifold for fluid collection from the different fan coils. A single pump draws condensate from fan coils through respective drainage conduits to the tank.

For economy in installation, a fan coil's drainage conduit preferably follows the same path to the indoor unit as the hydronic supply-return conduit servicing the fan coil. Drainage conduit is selected to be either integrated with the hydronic supply-return conduit or provided as a separate conduit. Integrated hydronic supply-return conduit is disclosed in co-pending application Ser. No. 07/698,266, filed on May 10, 1991, entitled "hydronic Thermal Distribution System for Space Heating and Cooling" and having a common assignee with the present invention. The pump also draws condensate from the tank and discharges that condensate at a discharge point. The pump also draws a vacuum in the tank and in the drainage conduits.

The fan coil valve is opened and closed by a float which is normally seated on a valve seat thus closing the valve. When closed, the valve creates a seal which maintains a vacuum in the drainage conduit. When the heat pump is in the cooling mode, condensate accumulates in the drain pan to cause the float to rise from the valve seat thus opening the valve. The open valve allows condensate flow from the drain pan into the drainage conduit. For some fan coils, gravity may be sufficient to drain condensate into the drainage conduit and there may also be sufficient gravity flow to cause the condensate to drain to the tank. Fan coils which are not drainable using gravity receive vacuum assistance to draw condensate into the drainage conduit; such assistance provided by the pump. The tank serves as a manifold to distribute vacuum generated by the pump through the different drainage conduits to their respective valves. A vacuum in the drainage conduit may initially be present when the valve opens. Alternatively, the pump that creates a vacuum may be activated by a float switch when the float reaches a predetermined first level above the valve seat.

As mentioned in the previous paragraph, a vacuum in the drainage conduit may be initially present when the valve opens. The vacuum may be present as a result of the pump then being in use to remove condensate from another fan coil or as a result of the pump then being in use to pump condensate from the tank. A float within the tank rises with rising condensate to a predetermined first level at which the float operates a switch to activate the pump. The pump creates a vacuum to remove condensate from the tank. When the condensate level and the float descend below a predetermined second level which second level is below the first level, then the pump is switched off.

As mentioned above, when the valve float rises to a predetermined first level above the valve seat, the pump is switch activated. It may happen that, due to valve blockage or due to other reasons, the condensate level within a fan coil nevertheless continues to rise. If the condensate level continues to rise, the valve float will rise to a predetermined third level to operate a switch that both deactivates the affected fan coil and activates a warning light or other alarm.

While the apparatus is disclosed with respect to heat pumps, it should be understood to be equally applicable to air conditioners, multi-zone dehumidifiers and other multi-zoned equipment having water condensation.

DESCRIPTION OF THE INVENTION

Figure 1:
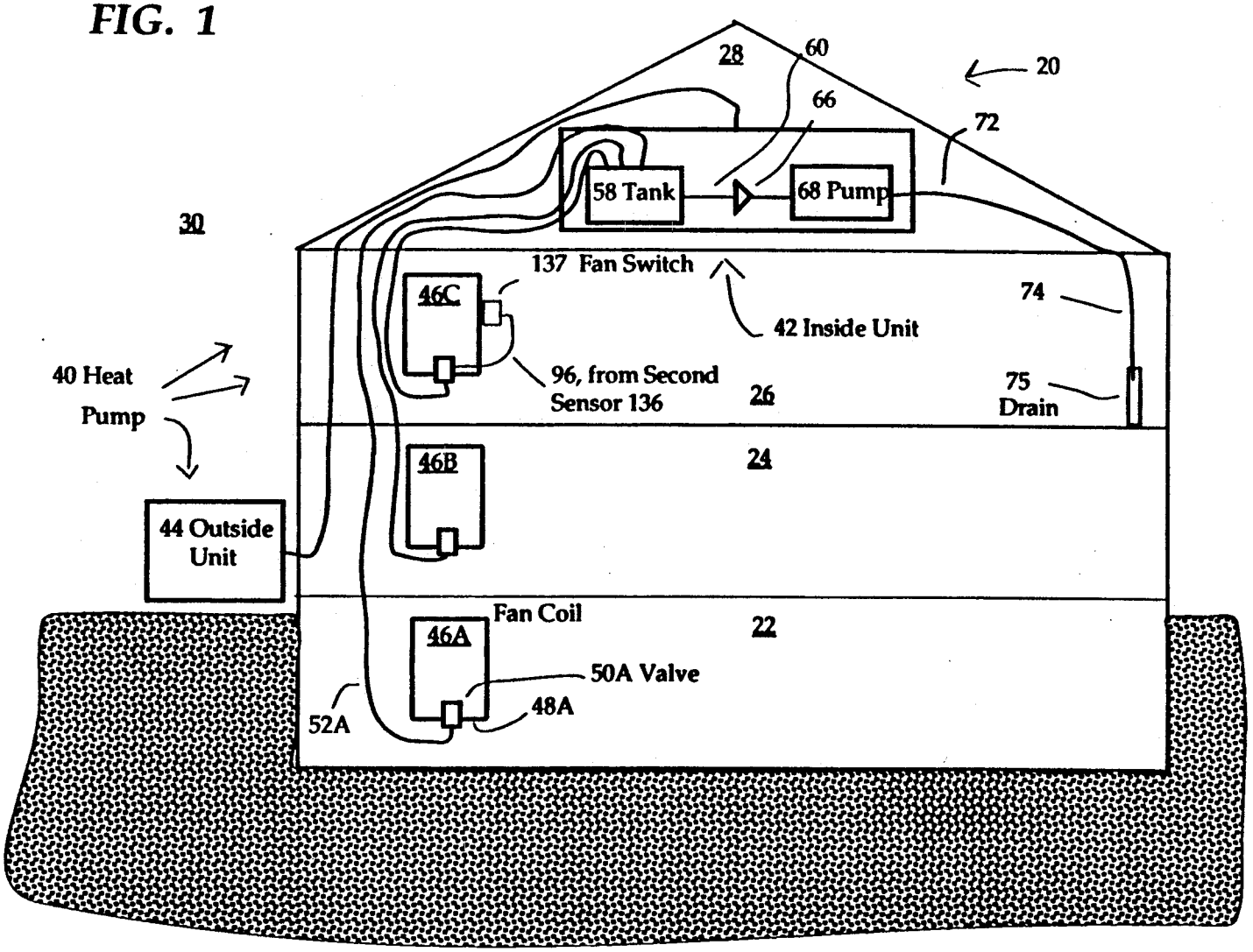
FIG. 1 is an elevational schematic in section of the present invention and the environment in which the present invention is used.

FIG. 1 provides an example of the environment in which the present invention is used. House 20 has three zones, low zone 22, mid-zone 24, and high zone 26. Low zone 22 is a basement which is below ground level. Mid-zone 24 ascends approximately from ground level. High zone 26, located over mid-zone 24, is the top story of house 20. Attic 28 is above high zone 26. While this example uses three zones, additional zones may be provided with multiple zones typically on the same story of a structure. The present invention is equally applicable to additional zones.

External to house 20 is outside 30 which is unsheltered ambient air. Heat pump 40, having a hydronic thermal distribution system, includes inside unit 42, outside unit 44, fan coil 46A, fan coil 46B, and fan coil 46C. Fan coil 46A, fan coil 46B, and fan coil 46C are located in and service low zone 22, mid-zone 24, and high zone 26, respectively. Inside unit 42, as is often the case, is located in attic 28. Outside unit 44 is located in outside 30 adjacent to house 20. Supply-return water conduit (preferably co-located with drainage conduit but not shown) services the fan coils. In cooling mode, supply water is cool and return water is warm.

Pan 48A is a drain pan at the bottom of fan coil 46A. Valve 50A passes through pan 48A. Fan coil conduit 52A joins valve 50A and tank 58. Valve 50A and fan coil conduit 52A provide a condensate flow path from fan coil 46A to tank 58. Tank 58 is housed with inside unit 42. Valve 50A has closed and open states which will be illustrated in a subsequent figure. The closed state prevents air and condensate from flowing from fan coil 46A through valve 50A into fan coil conduit 52A. Conversely, the open state of valve 50A permits condensate (but not air) to flow through valve 50A into fan coil conduit 52A and then to tank 58. The arrangement of valve 50A and fan coil conduit 52A are representative of their counterparts for other fan coils 46B and 46C.

Pump conduit 60, which has check valve 66, connects pump 68 to tank 58. Check valve 66 is alternatively a part of the pump 68 assembly. Check valve 66 provides unidirectional condensate flow within pump conduit 60 from tank 58 to pump 68. These connections provide a condensate flow path from tank 58 through check valve 66 to pump 68 and a vacuum flow path from pump 68 to tank 58. Pump 68 is capable of pumping condensate from tank 58 and also capable of drawing a vacuum in tank 58. Tank 58 and pump 68 are preferably part of inside unit 42 but may be part of outside unit 44.

Discharge conduit 72 is attached to pump 68 to provide a condensate flow path from pump 68. Discharge conduit 72 has its discharge end 74 typically located at a conveniently located pre-existing drain 75 within house 20. Alternatively, discharge conduit 72 has its discharge end 74 located at a discharge point outside house 20 where release of condensate will cause neither harm nor inconvenience.

The foregoing configuration provides indirect condensate flow paths from fan coil 46A, fan coil 46B, and fan coil 46C, respectively to drain 75. For fan coil 46A, for example, this indirect flow path is by way of valve 50A, fan coil conduit 52A, tank 58, pump conduit 60, check valve 66, pump 68, and discharge conduit 72.

It should be noted that runs of fan coil conduit 52A, while shown to be generally vertically descending may also include runs and bends which are alternatively horizontal, ascending, and descending. Such runs and bends may be necessary to avoid wall obstructions, to take advantage of wall cavities, or for other similar reasons. The present invention advantageously serves drainage conduit configurations and allows cost effective conduit installation that readily accommodates existing site conditions.

Figure 2:
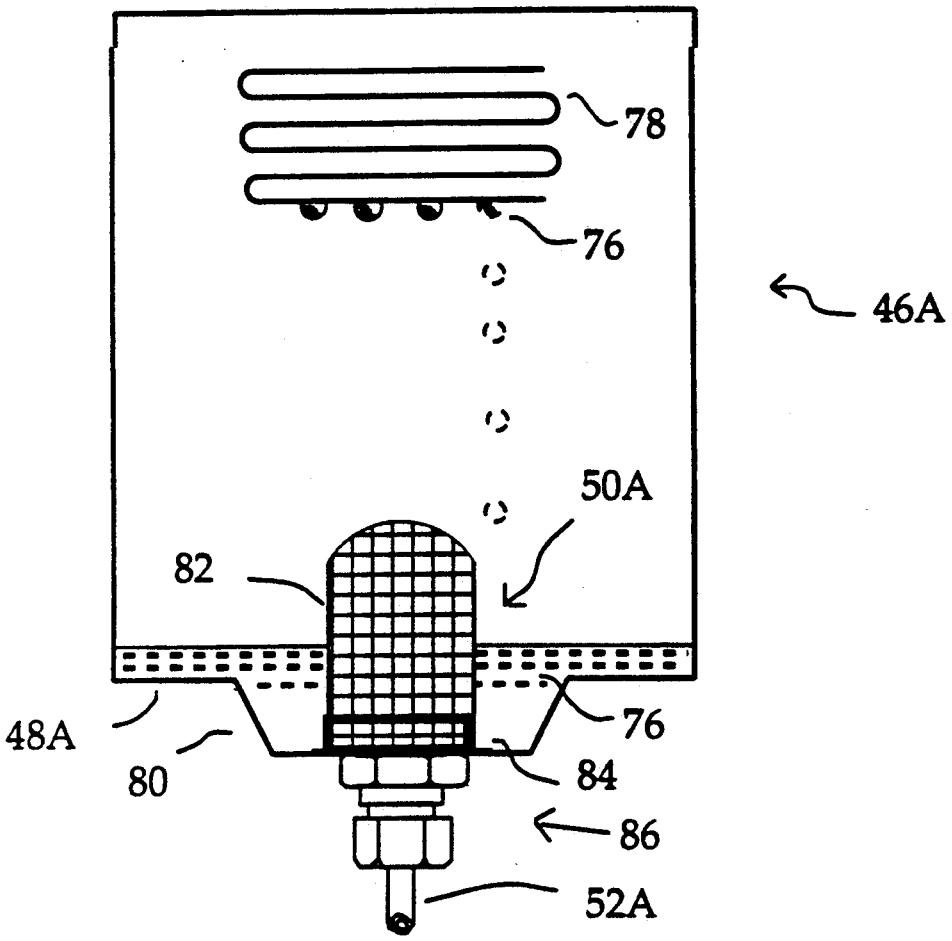
FIG. 2 is an elevational schematic showing a fan coil using a valve of the present invention and showing the manner of condensate collection in the drain pan of the fan coil.

FIG. 2 shows an elevational schematic of fan coil 46A having valve 50A and showing the manner of condensate 76 collection in pan 48A of fan coil 46A. It can be observed that condensate 76 first accumulates as water droplets on coil 78. Condensate 76 then drops to pan 48A where it is collected as a body of water that preferably occupies recess 80 defined by pan 48A so that condensate 76 partially inundates valve 50A. While recess 80 is preferable because it facilitates flow of condensate to valve 50A, recess 80 may be omitted from the present invention.

Strainer 82, which is a substantially vertical cylinder having a rounded top, provides a covering for valve 50A. Strainer 82 is constructed of sufficiently fine wire mesh as necessary to prevent particles from entering valve 50A. Upper portions of strainer 82 may be constructed of coarse wire mesh (relative to lower portions) to permit continued condensate flow through strainer 82 in the event that lower portions of strainer 82 become clogged. Strainer 82 is preferably easily removable for cleaning.

Valve 50A is installed through pan 48A in the recess 80 portion of of pan 48A. Pan 48A has a circular drain hole to receive valve 50A. Valve 50A is threadably fastened to pan 48A by base 84, which is disk-shaped, and by lower assembly 86. Lower assembly 86 is that portion of Valve 50A which is shown below recess 80. Fan coil conduit 52A is secured to valve 50A by lower assembly 86.

Figure 3:
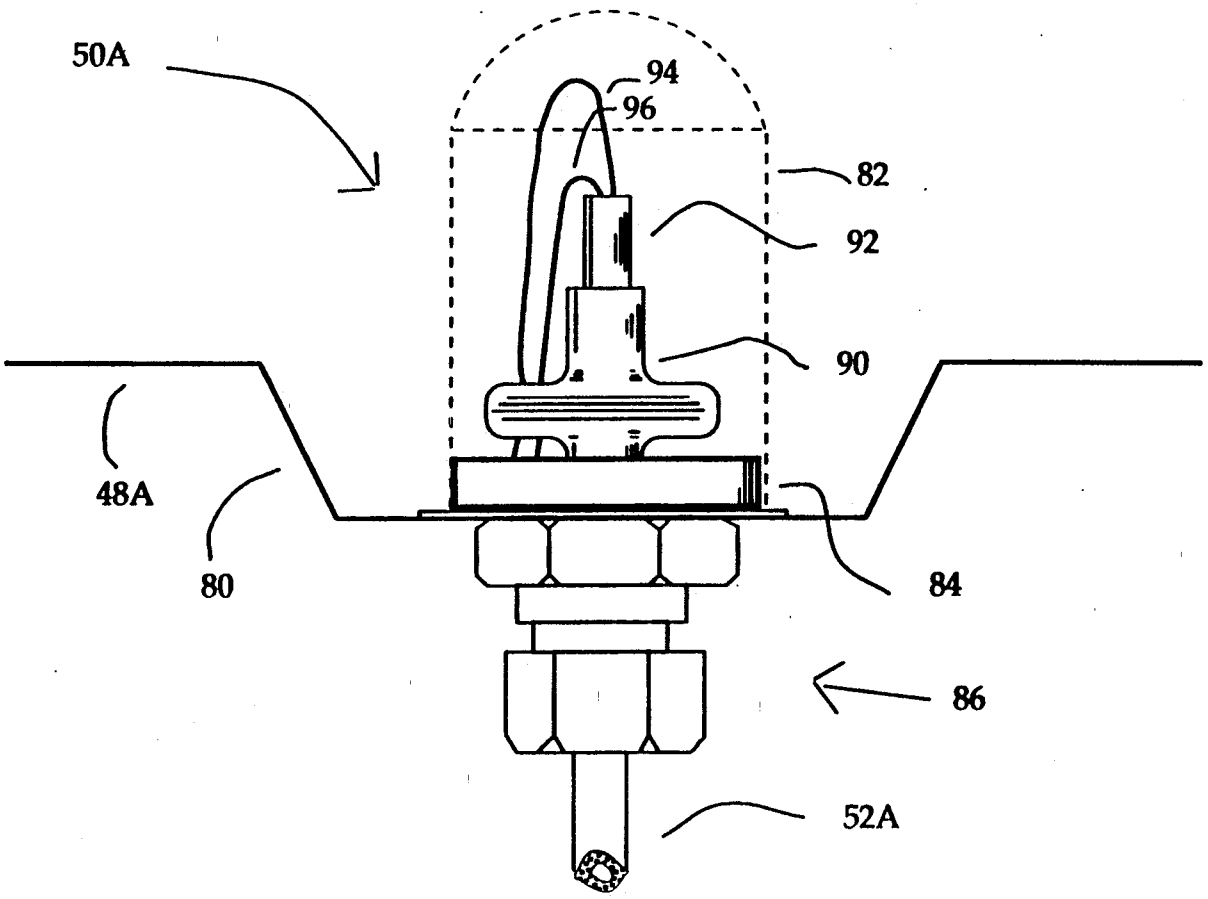
FIG. 3 is an elevational view of a valve of the present invention.

FIG. 3 shows valve 50A with strainer 82 is indicated in phantom to reveal valve float 90 and float guide 92. In this representation of valve 50A, condensate 76 is absent and valve float 90 is therefore shown seated on base 84. Float guide 92 permits float 90 to ascend and descend vertically which will be discussed in further detail below. Signal wires 94 and 96 protrude from float guide 92 and exit valve 50A by way of base 84. Float guide 92 is supported by a structure (not shown) which is attached to base 84.

Figure 4:
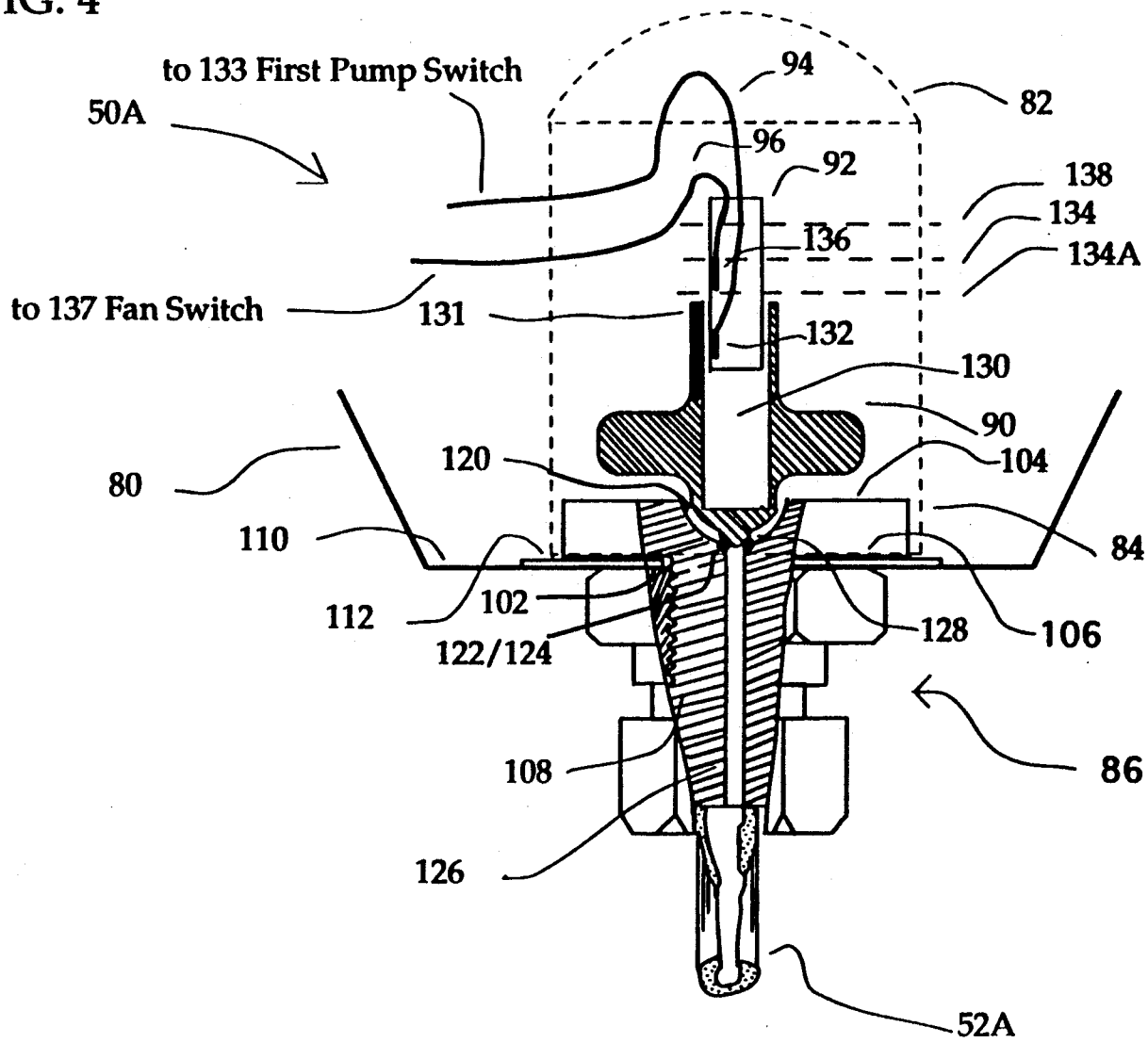
FIG. 4 is an elevational partial section view of a valve of the present invention.

FIG. 4 shows recess 80 and valve 50A in elevational partial section. Pan 48A has drain hole 102 which is a circular opening through which valve 50A is mounted. Base 84 has base top 104 and base bottom 106. Base bottom 106 is substantially planar except that threaded tubular fitting 108 projects downward from base bottom 106. Base 84 and fitting 108 are of unitary construction. Base bottom 106 is installed adjacent to recess surface 110 and is sealed by gasket 112 which is interposed between base bottom 106 and recess surface 110.

With base 84 so installed, fitting 108 projects downward through drain hole 102 to the exterior of fan coil 46A. Base 84 is threadably secured in this position by lower assembly 86. Lower assembly 86 also fastens fan coil conduit 52A to valve 50A.

Base top 104 is substantially planar except that base top 104 has centrally located valve inlet 120, which is a hemispherical indentation into base top 104. Valve inlet 120 has float seat 122 within it; said seat is lined with an "O" ring type seal 124. Valve port 126 extends axially through base 84 and through lower assembly 86. The valve described in this and the previous paragraph provides a sealable and unsealable watertight condensate flow path from recess 80 to valve inlet 120 past float seat 122 through valve port 126 and into fan coil conduit 52A. This same flow path is also a vacuum-tight vacuum flow path from fan coil conduit 52A to valve inlet 120.

Valve float 90, which is disposed above valve inlet 120, has convex hemispherical shaped float bottom 128 which float bottom 128 is sized to sealably match seal 124. Float bottom 128, when abutting seal 124, creates a vacuum seal which is capable of maintaining a vacuum in fan coil conduit 52A.

Valve float 90 has float chamber 130 which is a vertical, cylindrical void within valve float 90 having an opening at valve float top 131 which is the upper-most location on valve float 90. Valve float 90 is slideably mounted with cylindrical float guide 92 vertically disposed within float chamber 130. Float guide 92 thus permits valve float 90 to ascend vertically from seal 124 and to descend vertically to allow float bottom 128 to abut seal 124. Float guide 92 prevents lateral movement of valve float 90. Valve float 90 is constructed such that it has a specific gravity significantly smaller than 1 to allow valve float 90 to ascend when valve float 90 is supported by buoyant forces imposed by rising condensate 76.

Float guide 92 has first sensor 132, which is operated by valve float 90. First sensor 132 operates first pump switch 133 which is normally open and which is centrally located at inside unit 42. When condensate causes valve float 90 to rise to pump activation level 134 first sensor 132 closes first pump switch 133 to activate pump 68. Activation of pump 68 draws a vacuum in fan coil conduit 52A that causes condensate to flow from pan 48A (by way of recess 80) into fan coil conduit 52A. When valve float 90 descends below pump deactivation level 134A, first sensor 132 deactivates and first pump switch 133 is opened to deactivate pump 68.

While pump 68 may, at a particular time, be deactivated with respect to a sensor of a particular fan coil, it should be understood that pump 68 may remain activated in response to a sensor located in a valve 50 of a different fan coil.

Float guide 92 also has second sensor 136, which is operated by valve float 90. Second sensor 136 operates fan switch 137 which is normally closed. When, in exceptional conditions, condensate causes valve float 90 to rise to fan coil deactivation level 138, which is above pump activation level 134, then second sensor 136 opens fan switch 137 to deactivate the fan coil serviced by valve 50A. Valve float 90 may rise to fan coil deactivation level 138 as a result clogging of valve 50A or other valve 50A failure, clogging of fan coil conduit 52A, or as a result of failure of pump 68. During a partial blockage which does not result in float 90 rising to deactivation level 138, fan switch 137 operated by second sensor 136 remains closed. Accordingly, pump 68 allows for slow drainage caused by only partial blockage. In addition to deactivating the fan coil serviced by valve 50A, opening fan switch 137 causes a warning light, or other alarm, to activate to indicate the drainage problem.

Figure 5:
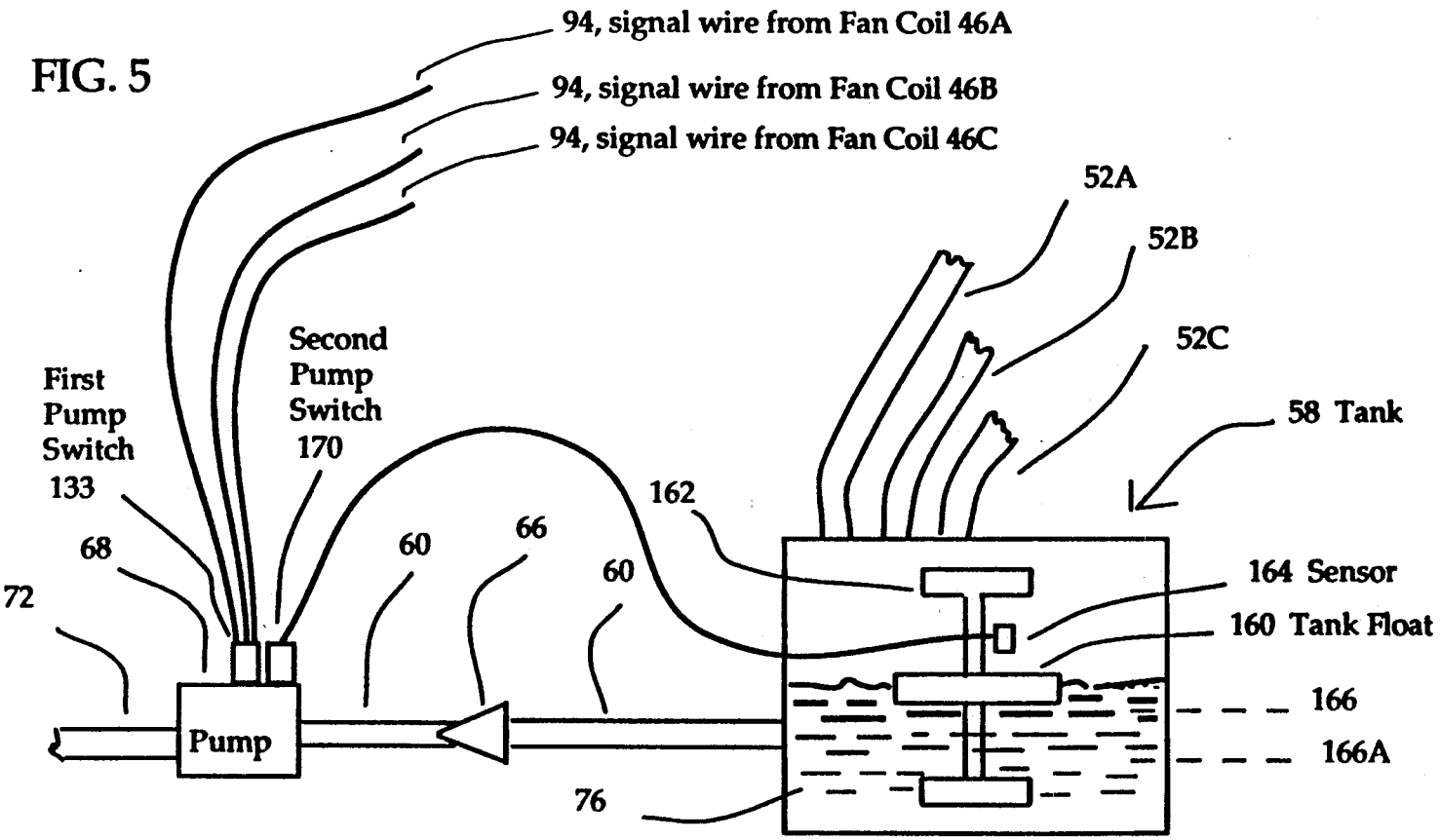
FIG. 5 is an elevational schematic in section of a condensate tank and pump of the present invention.

Turning now to FIG. 5, tank 58 is shown in cross section. Fan Coil conduits 52A, 52B, and 52C lead from fan coils 46A, 46B, and 46C, respectively to tank 58. Tank 58, while shown for illustration purposes with three drainage conduits, will support additional drainage conduits associated with a corresponding number of additional fan coils that a multi-zone heat pump system may have. Tank 58 serves as a manifold for condensate collection from the drainage conduits that it services.

Tank 58 has tank float 160 mounted on float guide 162. Tank float 160 operates tank sensor 164 which in turn operates second pump switch 170 to activate pump 68 when tank float 160 rises to a predetermined first level 166 as a result of buoyant force imposed by rising condensate. When sufficient condensate has been pumped from tank 58 as to cause tank float 160 to descend to a predetermined second level 166A, which is below the predetermined first level 166, then sensor 164 is operated by tank float 160 to operate second pump switch 170 thus deactivating pump 68. It is to be understood that pump 68 may nevertheless remain activated in response to sensors located in fan coils which sensors operate second pump switch 170.

FUNCTION OF THE PREFERRED EMBODIMENT

The function of the present invention is best illustrated by reference first to FIG. 2. In normal cooling operation, condensate forms in fan coil 46A. Condensate drips into drain pan 48A where it accumulates in recess 80. Recess 80 is provided to improve condensate flow into valve 50A.

Next, referring to FIG. 4, accumulation of condensate causes condensate level to rise. Valve float 90, buoyed by rising condensate, rises such that float bottom 128 separates from seal 124 to create a condensate flow path from recess 80, past seal 124, through valve port 126.

If gravitational force is sufficient to drain condensate from drain pan 48A into fan coil conduit 52A, then condensate will descend such that valve float 90 descends to cause float bottom 128 to sealably abut seal 124. This results in a sealing fan coil conduit 52A. If gravitational force is not sufficient to drain condensate from drain pan 48A into fan coil conduit 52A, then condensate and valve float 90 continue to rise until first sensor 132 is activated at pump activation level 134 which in turn closes second pump switch 170 centrally located at pump 68 as shown in FIG. 1. Closure of second pump switch 170 causes pump 68 to activate such that a vacuum is drawn through pump conduit 60 and tank 58 through fan coil conduit 52A. The vacuum causes condensate to flow into fan coil conduit 52A which in turn causes condensate to descend to pump deactivation level 134A such that first sensor 132 operates to open the second pump switch 170 to deactivate pump 68.

Next, referring to FIGS. 1 and 5, condensate flows into fan coil conduit 52A—either as a result of gravity or as a result of vacuum—to tank 58. Condensate in tank 58 rises causing tank float 160 to rise to activate sensor 164 which operates second pump switch 170 to activate pump 68. Pump 68 then draws condensate from tank 58 through pump conduit 60 to discharge condensate through discharge conduit 72 into drain 75.

A separate valve 50A, 50B, or 50C in each of fan coils 46A, 46B, and 46C services its respective fan coil. A separate fan coil conduit 52A, 52B, or 52C leading from valve 50A, 52B, and 52C, respectively, terminates in tank 58. Tank 58 acts as a manifold to permit a single pump 68 to service each fan coil and to draw a vacuum in each drainage conduit. Pump 68 disposes of condensate from tank 58 and also creates the required vacuum to service fan coils 46A, 46B, and 46C.

The operation just described for the present invention is normal operation in which condensate properly flows. However, a clog or other malfunction may obstruct condensate flow through valve 50A and condensate may continue to rise in drain pan 48A such that valve float 90 ascends to fan coil deactivation level 138. When valve float 90 ascends to fan coil deactivation level 138, second sensor 134 operates second pump switch 170 (normally closed) which opens to take fan coil 46A out of service. Opening second pump switch 170 also activates a warning light or other alarm to indicate problem status.

Persons skilled in the art of the present invention may, upon exposure to the teachings herein, conceive other variations. Such variations are deemed to be encompassed by the disclosure, the invention being limited only by the appended claims.

We claim:

1. In a heating, ventilation, and air conditioning system having fan coils, an apparatus for removing condensate generated by said fan coils, said apparatus comprising:

a drain pan in each fan coil for collecting condensate;

a valve in each said drain pan;

a manifold;

conduits, one conduit for each said valve, each said conduit providing fluid communication between a said valve and said manifold;

a pump in fluid communication with said manifold, said pump for drawing condensate from said drain pans through said valves into said conduits, then through said conduits to said manifold, said pump for drawing said condensate from said manifold and said pump for discharging said condensate;

each said valve having a float, each said valve having an open state and a closed state, said open state resulting from buoyant forces of said condensate upon said float, said open state permitting said condensate to flow from one said fan coil through one said valve, said closed state preventing condensate and air from flowing through said valve, and when all said valves are in said closed state said pump may draw a vacuum in said manifold and said conduits;

each said valve having a first sensor, said pump having a first pump switch such that when condensate rises to cause said float to ascend to a predetermined first level which first level is above said float seat, said float closes said first pump switch, and such that when condensate descends below said predetermined first level, said float opens said first pump switch, said pump operatively connected to each said first pump switch of each said valve such that any said first pump switch when closed activates said pump and such that all said first pump switches when opened deactivate said pump;

each said valve having a fan switch such that when said condensate rises within a said fan coil to cause said float to ascend to a predetermined second level which is higher than said predetermined first level, said float opens said fan switch and such that when condensate descends below said predetermined second level, said float closes said fan switch, said fan coil operatively connected to said fan switch such that said fan switch when closed deactivates said fan coil and such that said fan switch when opened activates said fan coil.

2. The apparatus of claim 1 wherein said manifold is a tank having a capacity to accumulate a volume of said condensate in said tank.

3. The apparatus of claim 2 wherein said tank further comprises a tank float and a second pump switch such that when said condensate rises within said tank to cause said tank float to rise to a predetermined third level, said tank float opens said second pump switch thereby activating said pump, and such that when said condensate descends below said predetermined third level, said tank float operates said second pump switch thereby removing activation of said pump by said second pump switch.

4. The apparatus of claim 1 wherein said valve further comprises a float seat and wherein said float has a float bottom disposed above said float seat, wherein said closed state results from said float bottom abutting said float seat as a result of gravitational forces on said float.

5. The apparatus of claim 4 wherein said manifold is a tank having a capacity to accumulate a volume of said condensate in said tank.

6. The apparatus of claim 5 wherein said tank further comprises a tank float and a second pump switch such that when said condensate rises within said tank to cause said tank float to rise to a predetermined third level, said tank float opens said second pump switch thereby activating said pump, and such that when said condensate descends below said predetermined third level, said tank float operates said second pump switch thereby removing activation of said pump by said second pump switch.

* * * * *